United States Patent [19]

Butcher

[11] Patent Number: 4,497,453

[45] Date of Patent: Feb. 5, 1985

[54] DISPENSER FOR INTERNALLY SELF-SUPPORTED ROLLED MATERIAL

[76] Inventor: Henry P. Butcher, 2843 NE. 18th Ct., Ocala, Fla. 32670

[21] Appl. No.: 494,883

[22] Filed: May 16, 1983

[51] Int. Cl.[3] ..... B65H 19/00; B65H 17/12

[52] U.S. Cl. ..... 242/55.53; 242/68.7; 312/39; 312/41

[58] Field of Search ..... 242/55.53, 78.7, 68.7, 242/DIG. 3, 66; 225/46, 47, 52, 77, 88; 221/70, 71, 83; 226/186, 187; 312/38–41

[56] References Cited

U.S. PATENT DOCUMENTS

| | | | |
|---|---|---|---|
| 943,279 | 12/1909 | Smith | 242/55.53 |
| 2,144,757 | 1/1939 | Gilling et al. | 242/55.53 |
| 2,730,310 | 1/1956 | Schultz | 242/68.7 |

FOREIGN PATENT DOCUMENTS

| | | | |
|---|---|---|---|
| 111342 | 8/1980 | Japan | 242/78.7 |
| 2053847 | 2/1981 | United Kingdom | 242/68.7 |

*Primary Examiner*—Leonard D. Christian
*Attorney, Agent, or Firm*—Roger L. Martin

[57] ABSTRACT

The invention has to do with a wall dispenser for rolled plastic material that is internally self-supported and without the aid of a cylindrical core component. The dispenser has a pair of rollers on which the roll rests and which are so supported in end wall slots that they may be moved toward and away from each other and generally relative to a slot in the bottom wall of the dispenser and through which the web of plastic material is dispensed. Tension springs connected to the rollers continuously urge the rollers toward one another and this transpires automatically as the material is dispensed and the weight of the roll diminishes. Provisions are made for adjusting the spring tension in the form of threaded members that are connected to the springs and vertically adjustably mounted in end wall slots of the dispenser.

4 Claims, 7 Drawing Figures

DISPENSER FOR INTERNALLY SELF-SUPPORTED ROLLED MATERIAL

This invention relates to improved dispensers for flexible plastic material that in the form of a web is rolled entirely upon itself to provide an internally self-supported roll of the material.

BACKGROUND OF THE INVENTION

Dispensers for material that in the form of a web is rolled upon an internal support for the wound material such as on a cylindrical core, are known. Typical of such dispensers are those for dispensing paper towels which are manufactured and distributed in the form of rolls. The towel forming material, as a web, is scored transversely at predetermined spaced intervals between its opposite ends and is rolled upon a cardboard cylindrical core in most instances and which provides an internal support for the roll of material. A typical dispenser for such rolls has a pair of spaced rollers that are located in a compartment and the roll of towels rests on the rollers as the web is removed from the dispenser through a suitable slot in the bottom wall thereof. The core serves to maintain the cylindrical shape of the roll until the entire web has been dispensed.

Webs of certain types of plastic materials are also rolled upon a cylindrical core for distribution and use. One such type of plastic material is a product known as Saran Wrap and which is marketed by Dow Chemical under its Saran trademark. The plastic material in this case clings to itself and once rolled tends to maintain a tight roll that does not readily unwind.

While the above referred to plastic material is readily wound upon a core component that provides internal support for the roll, other plastic materials are marketed as rolls which lack the internal supporting core component. The polyethylene and polypropylene plastic materials have a low coeffecient of friction so that the material readily slides upon itself as well as other materials. Because of its slippery nature, a roll of this type of material becomes loosely wound after being initially wound into a rolled form because any tension in the rolled material is readily relieved for reasons of the low coefficient of friction that the material exerts with respect to itself. Furthermore, such materials are not readily secured to core forming materials by conventional adhesives and because of this such slippery plastic materials are usually rolled entirely upon themselves without the use of core components. As such, such rolls may be considered as internally self-supported as compared to those which are supported internally by a core member of component.

So-called "garbage bags" are typical products which are made of such slippery materials and which are marketed in the form of a roll that lacks an internal core supporting component. In such cases, the web of slippery plastic material is entirely wound upon itself. The web in such cases is usually made up of two plys that are heat sealed together at spaced intervals and suitably scored to facilitate the severance of each individual bag from those remaining on the roll as the bags are consumed. The material used in the formation of the web is especially slippery so that the maintenance of a tight roll of the material is next to impossible from a practical standpoint.

SUMMARY OF THE INVENTION

The invention has to do with a roll of plastic material in which the web forming the roll is entirely rolled upon itself and to an improved dispenser for such rolled material. Small rolls that are formed by rolling a web of slippery plastic material entirely upon itself to provide an internally self-supported roll of the material tend to take on an elliptical cross sectional shape when resting on a flat surface. Being slippery, the plastic material tends to slide and slip longitudinally of the web and to become loosely wound upon itself in the roll form. If the roll of material is placed in a dispenser of conventional design that is equipped with spaced rollers, the material in the roll sags in the region between the rollers and ultimately comes to rest upon the bottom wall of the dispenser as the material in the roll is consumed. This interferes with the proper withdrawal of the web as the material is consumed and with scored material frequently results in a severance of the web within the dispenser and hence an inability to thereafter withdraw the web from the interior of the dispenser.

A general object of the invention is to provide an improved dispenser for materials which in the form of a web are rolled entirely upon themselves and which are thus internally self-supported in the form of a roll without the aid of an internally located core component in the roll. Yet another object is to provide an improved wall mounted dispenser for an internally self-supported roll of plastic material and which is equipped to support the roll of plastic material on a pair of rollers as the web is dispensed. One particular object is to provide a dispenser for rolled materials of the kind contemplated and wherein the supporting rollers for the rolls automatically adjust to accommodate the change in the size and shape of the roll as the material is dispensed. Still a further object is to provide a dispenser for materials of the kind contemplated and which facilitates the withdrawal of the entire web from the dispenser and without unnecessary breaking of the web during its withdrawal from the roll. Still another object is to provide an improved dispenser for materials of the kind contemplated herein and which is inexpensive to manufacture.

In accord with the invention provisions are made in the structure of the dispenser for the roll of slippery plastic material to facilitate limited movement of the roll supporting rollers toward and away from each other and thus generally toward and away from the slot in the bottom wall through which the web of material is withdrawn to the exterior of the dispenser for consumption. In conjunction with the above, provisions are also made in the dispenser to continuously urge the rollers relatively toward one another. Springs are used to urge the rollers generally toward the bottom wall slot and here provisions are made for adjusting the tension of the springs. The arrangement gradually brings the rollers together as the material of the roll is consumed and this maintains the roll in a roller supported position which facilitates the withdrawal of the web without undue resistance to such withdrawal for reasons of frictional contact of the rolled material with the bottom wall of the dispenser in the area between the rollers.

DESCRIPTION OF DRAWINGS

The novel features which are believed to be characteristic of this invention are set forth with particularity in the appended claims. The invention, itself, however, both as to its organization and method of operation, together with further objects and advantages thereof, may best be understood by reference to the following descriptions taken in connection with the accompanying drawings, wherein:

DETAILED DESCRIPTION OF INVENTION

Figure 1:
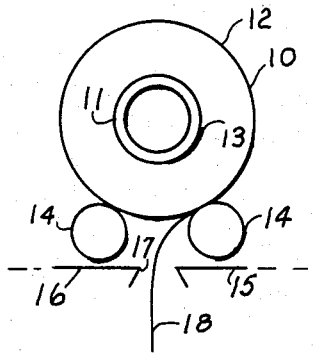
FIG. 1 is a schematic drawing that illustrates the manner in which a roll of material that is internally supported by a core component rests upon the roll supporting rollers of a conventional dispenser therefore.
Figure 2:
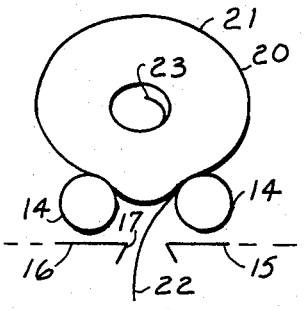
FIG. 2 is a schematic drawing that illustrates the manner in which a roll of material that is internally self-supported entirely upon itself rests upon the roll supporting rollers of a conventional dispenser.
Figure 3:
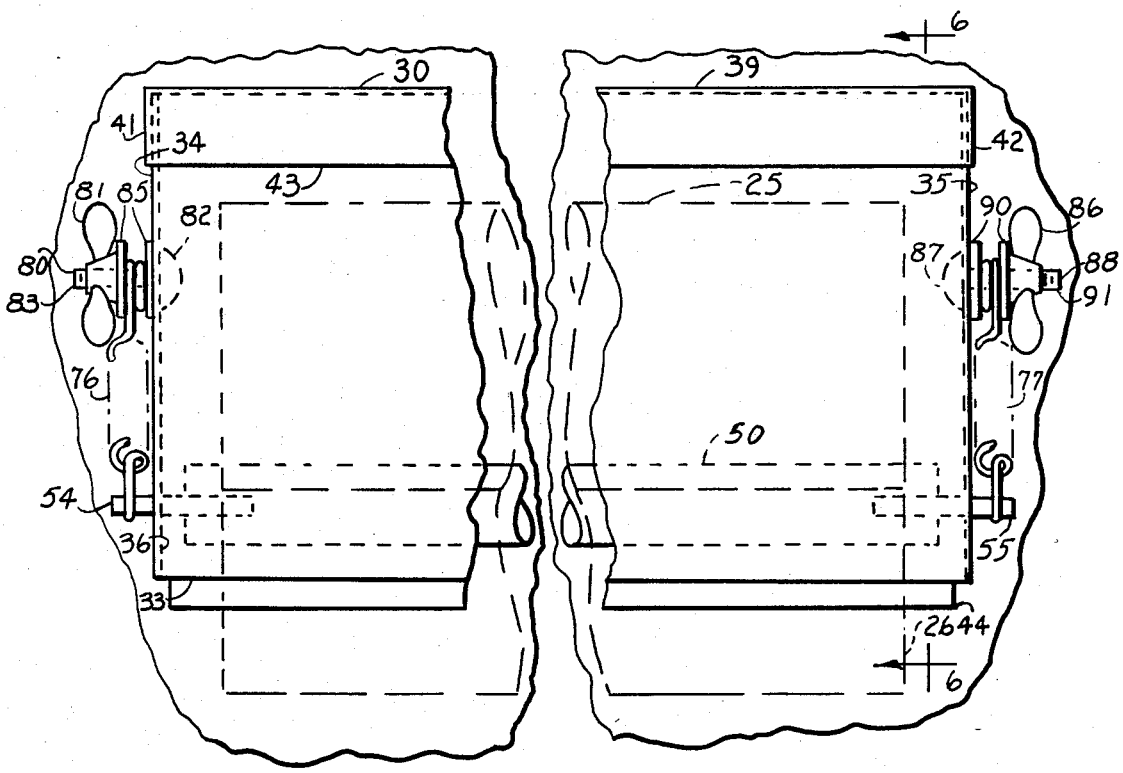
FIG. 3 is a front view of a dispenser embodying the principles of the invention, with certain parts broken away.
Figure 4:
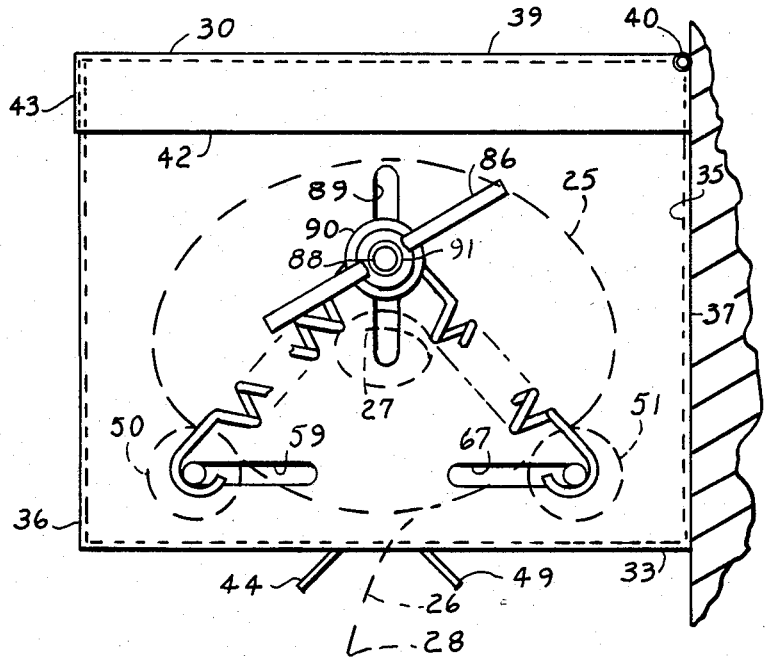
FIG. 4 is a right side view of the dispenser seen in FIG. 3.
Figure 5:
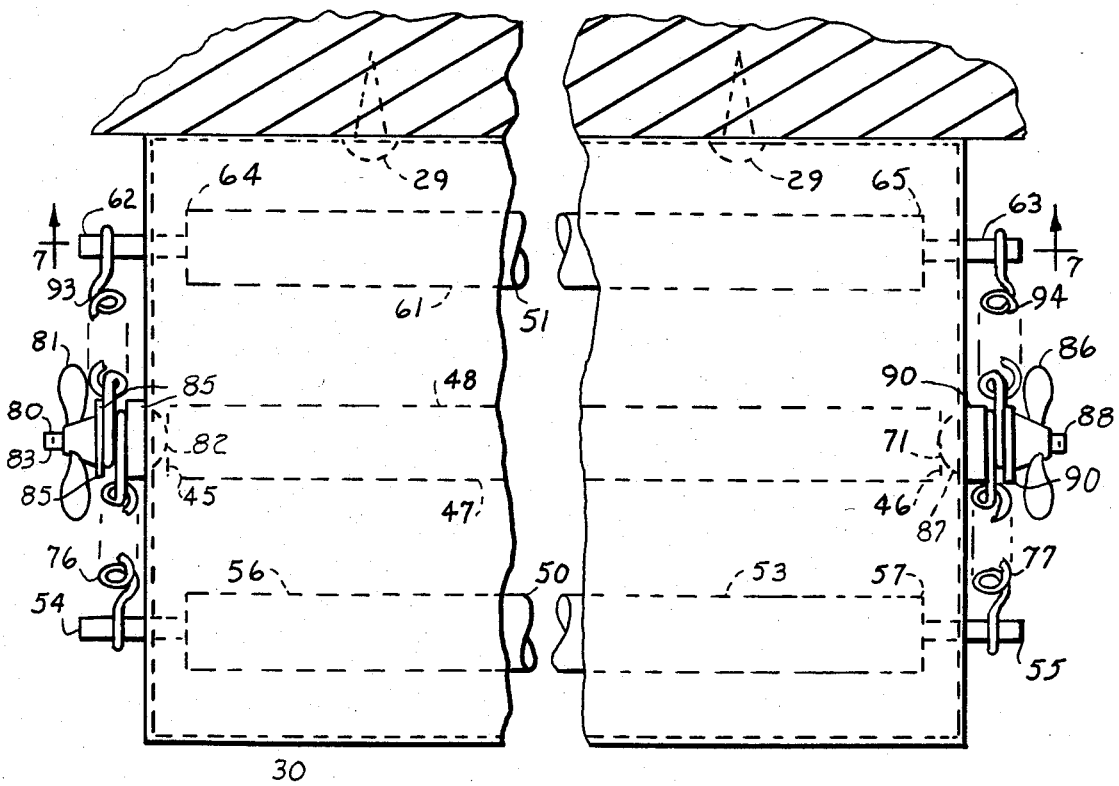
FIG. 5 is a top plan view of the dispenser seen in FIG. 3, certain parts being broken away.
Figure 6:
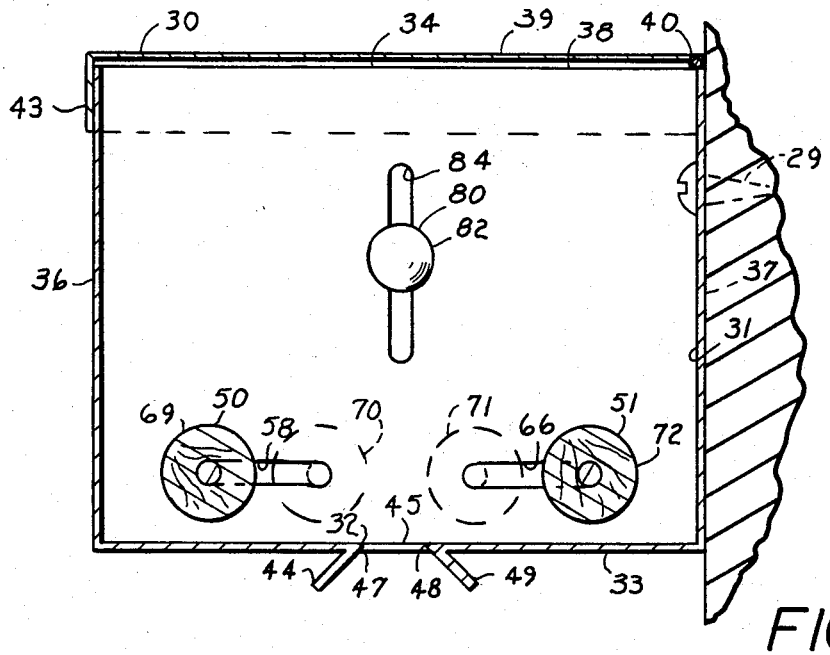
FIG. 6 is a transverse section taken generally along the Lines 6—6 of FIG. 1.
Figure 7:
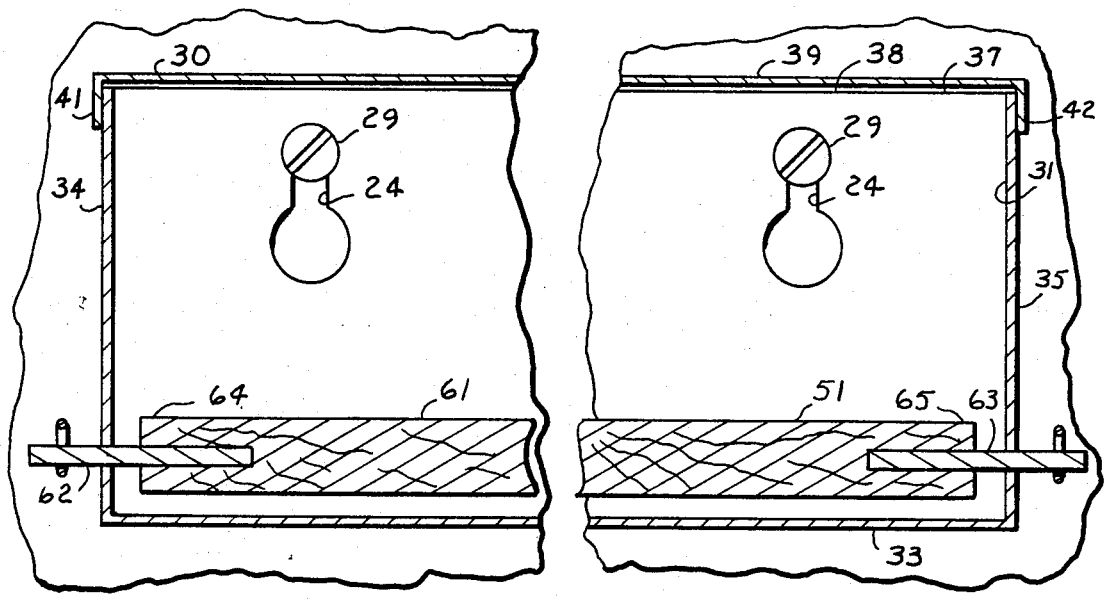
FIG. 7 is a longitudinal section taken generally along the Lines 7—7 of FIG. 5.

Reference is now made to the drawings and in particular to FIGS. 1 and 2 which generally serve to point up the problem of dispensing internally self-supported rolled materials in comparison to the dispensing of internally core supported rolled material.

FIG. 1 schematically illustrates a web 10 of material that has been rolled upon a cylindrical core member 11 to provide a roll 12 in which the inner end portion 13 of the web 10 is rolled upon the core 11 for internal support of the roll. The roll 12 is depicted as resting on a pair of rollers 14 that are spaced apart in the internal compartment of a dispenser 15 which is equipped with a bottom wall 16. Wall 16 has an elongated slot through which the web 10 is withdrawn as the rolled material is consumed. As seen in FIG. 1, the outer end portion 18 of the web 10 extends between the rollers 14 and through the slot 17 to the exterior of the dispenser and whereat the end portion 18 can be grasped to facilitate the withdrawal of the material from the roll. This type of internal supporting of a roll through use of a core member of component is usually used with paper towel rolls. The core serves to maintain a substantially cylindrical shape in the roll as the web is withdrawn and, in most dispensers for such rolled materials, the space between the roll supporting rollers 14 is slightly less than the diameter of the core component. As such, the roll is supported on the rollers until the very last of the web is consumed.

FIG. 2 schematically illustrates another web 20 of material which is also wound into the form of a roll 21. Here, however, it is assumed that the web 20 is a two ply component that provides a plurality of series connected plastic garbage type bags that are made from slippery plastic material, such as polyethylene or polypropylene materials. The web 20 is wound entirely upon itself inwardly of the outer end portion 22, and the inner end portion 23 of the web provides the innermost supporting structure in the roll. As such, in this roll 21, there is no core component and the web 20 is wound into an internally self-supported roll which relies entirely upon its own strength to maintain its shape.

The roll 21 seen in FIG. 2 is schematically illustrated as resting on the rollers 14 of dispenser 15 with the outer end portion 22 of the web 20 extending through the space between the rollers 14 and to the exterior through the slot 17 in the bottom wall 16 of dispenser 15. Being made of slippery plastic material, the web tends to become loosened on the roll 21 and without a core component, tends to flatten out as it rests upon the rollers 14. As such, the rolled material sags into the region between the rollers 14. As the web is consumed, the rolled material sags even more so into the region between the rollers 14, and eventually contacts the bottom wall 15 itself. When this happens, in a conventional type of dispenser, the resistance to withdrawal of the web 20 from the dispenser increases and the web frequently parts along a scored line that remains within the dispenser compartment. This, of course, prevents withdrawal of the remaining portion of the roll 21 from the dispenser without gaining access to the interior of the dispenser for purposes of seeking out the then remaining end portion of the rolled material.

Reference is now made to the preferred embodiment of the invention shown in FIGS. 3–7. Here the dispenser is shown as a wall mounted device which is designated at 30. It has an interior compartment 31 for housing a roll 25 of the flexible plastic material, and the material is dispensed from the compartment 31 through an elongated slot 32 which is located in the bottom wall 33 of the dispenser. The dispenser is mounted on a side wall of a structure by means of a pair of headed fasteners 29 that extend through appropriately spaced part slots 24 in the back wall 37 of the dispenser.

The roll 25 is formed from an elongated web 26 of the plastic material. The web has an inner end portion 27 and an outer end portion 28. Inwardly of the outer end portion 28, the web 26 is rolled entirely upon itself and, as such, forms an internally self-supported roll of the flexible material. As previously pointed out, this type roll, since it lacks internal support from a core component and is formed of slippery plastic material, tends to flatten out and become loosely wound into the roll form. The dispenser 30 in addition to the rectangular bottom wall 33 has a pair of spaced part opposite end walls 34 and 35 and a pair of spaced apart front and back side walls 36 and 37. End walls 34 and 35 and front and back side walls 36 and 37 are rectangular in shape and, as seen in the drawings, are fixed upright to the bottom wall 33 to define the interior compartment 31 in which the roll 25 is housed. The arrangement provides a rectangular upper opening 38 for access to the compartment 31. Here the dispenser 30 is provided with a rectangular top wall or cover 39 that is pivotally connected to the back wall 37 by a hinge designated at 40 and located along the upper edge of the back wall 37. The cover 39 has depending opposite end flanges 41 and 42 that lap the upper edge portions of end walls 34 and 35 when the cover is closed. The cover also has a front flange 43 that depends and laps the upper edge portion of the front wall when the cover is closed. The walls 33 through 37 and cover 39 may be made from sheet material or other suitable material.

The elongated slot 32 in the horizontal bottom wall 33 has opposite ends 45 and 46 and opposite sides 47 and 48. Here the bottom wall is bent downwardly and partly back upon itself to provide a pair of guides 44 and 49 at the opposite sides 47 and 48 of the slot so as to provide for smooth withdrawal of the web from the interior of the dispenser.

Within the compartment, the dispenser is equipped with a pair of elongated, cylindrical rollers 50 and 51 that are horizontally arranged and horizontally spaced apart within the compartment 31. Roller 50 is located laterally of and at the front side 47 of slot 32 whereas roller 51 is located laterally of and at the back side 48 of the slot 32.

The opposite end walls 34 and 35 are fixed upright to the bottom wall 33 at the opposite ends 45 and 46 of slot 32 and provide a means for supporting the rollers 50 and 51 generally in parallel with each other and in an upwardly spaced relation to the bottom wall 33 of dispenser 30. In this respect, each roller has an elongated, cylindrical wooden member that is equipped at its opposite ends with a pair of metal pins that serve as axial extensions which project through a pair of slots that are located in the opposite end walls and associated with the rollers. Thus roller 50 has an elongated, cylindrical wooden member 53 and a pair of metal pins 54 and 55 that are axially arranged at the opposite ends 56 and 57 of the roller 50 and partially embedded in the adjacent ends of member 53 thereat. Roller 50 is associated with a pair of slots 58 and 59 that are respectively located in end walls 34 and 35, and the pins 54 and 55 form axial extensions of the roller 50 and project through the respective slots 58 and 59 and to the exterior of the dispenser as seen in the drawings. Roller 51 on the other hand is made from an elongated, cylindrical wooden member 61 and has another pair of pins 62 and 63 that form the axial extensions at the opposite ends 64 and 65 of the roller 51. Roller 51 is associated with another pair of slots 66 and 67 in the opposite end walls 34 and 35 and the pins 62 and 63 of this roller similarly project through the slots 66 and 67 to the exterior of the compartment.

Slot 58 in end wall 34 is horizontally aligned with slot 59 in end wall 35 and both slots are located laterally of the front side 47 of the bottom wall slot 32. Slot 66 in end wall 34 on the other hand is horizontally aligned with the slot 67 in end wall 35 and both of these slots are located laterally of the back side edge 48 of the bottom wall slot 32. Slots 58 and 59 are arranged to accommodate horizontal movement of roller 50 generally toward and away from the slot 32 in the bottom wall 33 as, for example, between the outer and inner positions for the roller 50 and which are designated at 69 and 70 in FIG. 6. Slots 66 and 67, on the other hand, are arranged to accommodate general movement of roller 51 toward and away from the bottom wall slot 32, as, for example, between the inner and outer positions 71 and 72 shown in FIG. 6.

Each roller is also associated with a pair of tension springs that provide a means for continuously urging the roller generally toward the slot 32 in the bottom wall 33. The springs of each pair are connected to the respective pins of the roller at the exterior of the dispenser and each spring is connected to the adjacent end wall through a connection with a vertically adjustable threaded member that is mounted on the adjacent end wall.

The pair of springs associated with roller 50 are designated at 76 and 77 and are respectively connected to the pins 54 and 55 at the opposite ends 56 and 57 thereof. In the end wall 34, dispenser 30 is provided with a threaded member 80 that is equipped with a wing nut 81 at the exterior of the dispenser. The head of the member is located in the dispenser compartment while the shank 83 extends through a vertical slot 84 in the end wall 34. Spring 76 is connected to the shank 83 of member 80 between a pair of washers 85 that are located on the shank 83 between the wind nut 81 and side wall 34. At the other end wall 35, spring 37 is connected to the shank 88 of another threaded member 91. The head 87 of this member 91 is again located in the compartment like that of member 80 while the shank 88 extends through a vertical slot 89 to the exterior of the dispenser. Here the spring 77 is connected to the shank 88 between a pair of washers 90 and clamped in place through the manipulation of the wing nut 86.

The pair of springs associated with roller 51 are designated at 93 and 94 and are respectively connected to the pins 62 and 63 at the opposite ends 64 and 65 of roller 51. Spring 93 is also connected to the threaded member 80 while spring 94 is connected to the threaded member 91 in end wall 35.

Preparatory for use, each of the members 80 and 91 is vertically located in its end wall slot to provide the tension desired in the adjacent springs so as to continually urge the rollers toward each other and thus generally toward the slot in the bottom wall. This is accomplished, as by reference to member 91, by loosening the wing nut 86 to release the clamping action on the wall between the head 87 of the member 91 and the adjacent washer 85. The member may then be raised or lowered in the end wall slot 89 to adjust the tension in the springs 77 and 74 and the wing nut 86 may then be screwed on the shank 88 to again clamp the end wall between the head 87 and the adjacent washer 90. The tension of springs 76 and 93 is similarly adjusted by manipulation of the member 80 to change its position in the end wall slot 84.

In practice, the initial weight of the roll 25 of plastic material as it rests on the rollers will maintain the rollers 50 and 51 at the outer positions 69 and 72. With the outer end portion 28 of the web 26 projecting through the space between the rollers 50 and 51 and through the slot 32, the material may be withdrawn by hand from the dispenser in the conventional manner. As the web 26 is consumed, the roll 25 tends to flatten out more so than when originally placed in the compartment. This happens because the web tends to unwind for reasons of the slippery nature of the plastic material and for reasons of the lack of an internal supporting core member in the rolled structure. However, as the weight of the roll diminishes with the withdrawal of the web from the dispenser, the springs progressively draw the rollers closer together and toward their inner positions 70 and 72. As such, this compensates for the greater tendency to sag into the space between the rollers by reducing the space therebetween.

In the preferred embodiment, spring tension is applied to both rollers to continuously urge the rollers to move toward each other. Such relative movement of the rollers together may be also accomplished, of course, by simply mounting one roller so that it is movable toward the other roller and all while the latter roller is mounted for simple rotational movement but without the ability to move horizontally as in the aligned wall slots provided in the preferred embodiment.

While only certain preferred embodiments of this invention have been shown and described by way of illustration, many modifications will occur to those skilled in the art and it is, therefore, desired that it be understood that it is intended herein to cover all such modifications that fall within the true spirit and scope of this invention.

What is claimed as new and what it is desired to secure by Letters Patent of the United States is:

1. In a wall mounted dispenser having an interior compartment and an elongated web of flexible material located in the compartment, the improvement wherein said material is plastic material, said web has inner and outer end portions and, inwardly of the outer end portion, is rolled entirely upon itself to provide an internally self-supported roll of said material, and said dispenser has a horizontally arranged bottom wall provided with an elongated slot having opposite ends and opposite sides, a pair of elongated cylindrical rollers horizontally spaced apart within the compartment and located laterally of and at said opposite respective sides, and means supporting said rollers generally in parallel and spacedly above said bottom wall; said supporting means being adapted and arranged to accommodate the limited lateral movement of one of the rollers toward and away from the other of said rollers, said dispenser having means continuously urging said one roller toward said other roller, and said roll being restingly supported on said rollers with the outer end portion of the web extending through the space therebetween and through the slot in said bottom wall.

2. In a wall mounted dispenser having an interior compartment and an elongated web of flexible material located in the compartment, the improvement in accord with claim 1 wherein said dispenser has upright end walls fixed to the bottom wall at said opposite respective ends, said end walls providing said supporting means and having a pair of elongated and horizontally extending slots which are horizontally aligned and located at said opposite respective ends and laterally of one of said opposite sides; said one roller has opposite ends and elongated axial extensions located at the opposite respective ends thereof, said extensions being respectively arranged to project to the exterior of the dispenser through said slots, said slots being arranged to accommodate said limited lateral movement of said one roller; and said continuously urging means comprises a pair of tension springs respectively connected to said extensions and to said end walls.

3. In a wall mounted dispenser having an interior compartment and an elongated web of flexible material located in the compartment, the improvement wherein said material is plastic material, said web has inner and outer end portions and, inwardly of the outer end portion, is rolled entirely upon itself to provide an internally self-supported roll of said material, and said dispenser has a horizontally arranged bottom wall provided with an elongated slot having opposite sides and opposite ends, a pair of upright end walls fixed to the bottom wall at said opposite respective ends, and a pair of elongated cylindrical rollers horizontally spaced apart within the compartment and located laterally of and at said opposite respective sides; said end walls having two pairs of horizontally extending slots, said pairs being respectively associated with said rollers, and the slots of each of said pairs being horizontally aligned and located in said end walls laterally of and at one of said opposite sides; each of said rollers having opposite ends and elongated axial extensions located at the opposite respective ends of the roller, said extensions being respectively arranged to project to the exterior of the dispenser through the slots associated with said roller; said dispenser having a pair of tension springs respectively secured to said end walls and to the extensions of one of said rollers for continuously urging said one roller toward the other of said rollers, and said roll being restingly supported on said rollers with the outer end portion of the web extending through the space therebetween and through the slot in said bottom wall.

4. In a wall mounted dispenser having an interior compartment and an elongated web of flexible material located in the compartment, the improvement in accord with claim 3 wherein said dispenser has a pair of members respectively mounted on said end walls and respectively connected to said springs, each of said members being vertically adjustable to vary the tension in the spring secured thereto.

* * * * *